US006363858B1

(12) United States Patent
Voirin

(10) Patent No.: US 6,363,858 B1
(45) Date of Patent: Apr. 2, 2002

(54) TRANSPORT DEVICE COMPRISING AT LEAST ONE CARRIAGE OR LIKE VEHICLE CIRCULATING ON A CABLE

(75) Inventor: Philippe Voirin, Gerardmer (FR)

(73) Assignee: Aerofun (Societe a Responsabilite Limitee), Gerardmer (FR)

( * ) Notice: Subject to any disclaimer, the term of this patent is extended or adjusted under 35 U.S.C. 154(b) by 0 days.

(21) Appl. No.: 09/525,468

(22) Filed: Mar. 15, 2000

(30) Foreign Application Priority Data

Mar. 17, 1999 (FR) ..... 99 03488
Oct. 20, 1999 (EP) ..... 99440279

(51) Int. Cl.[7] ..... B61B 7/00; B61B 3/00; E01B 25/16

(52) U.S. Cl. ..... 104/173.1; 104/112; 104/117.1; 104/91; 148/151

(58) Field of Search ..... 104/173.1, 112, 104/117.1, 89, 91, 249; 105/148, 151

(56) References Cited

U.S. PATENT DOCUMENTS 808,183 A * 12/1905 Alexander ..... 104/87
2,953,116 A * 9/1960 Lund ..... 119/785
3,018,738 A * 1/1962 Naud ..... 105/151
3,070,035 A 12/1962 Russo et al.
4,691,642 A * 9/1987 Creissels ..... 104/173.1
4,712,486 A * 12/1987 Tarassoff ..... 104/173.1
4,892,508 A * 1/1990 Ryan et al. ..... 474/101
5,113,768 A * 5/1992 Brown ..... 104/112
5,224,425 A * 7/1993 Remington ..... 104/53
5,626,078 A * 5/1997 Fuchs ..... 104/28
5,638,755 A 6/1997 Love et al.
5,957,056 A * 9/1999 Behar ..... 104/59

FOREIGN PATENT DOCUMENTS

CH 452581 5/1968
DE 1074068 1/1960

* cited by examiner

*Primary Examiner*—Stephen T. Gordon
*Assistant Examiner*—Greg Blankenship
(74) *Attorney, Agent, or Firm*—Young & Thompson

(57) ABSTRACT

A transport device includes a vehicle on an elongated support element extending between a departure station and an arrival station, the departure station being located at a higher elevation than the arrival station. The arrival station includes at least one braking unit for slowing the vehicle. The braking unit may be a series of rollers that engage the vehicle or a series of downwardly depending members that strike lateral extension from the vehicle.

20 Claims, 7 Drawing Sheets

PH
PM
15
15'
15''
15'''
6
6'
6''
6'''
10
16
3
2
2,2'
7
12
12'
11

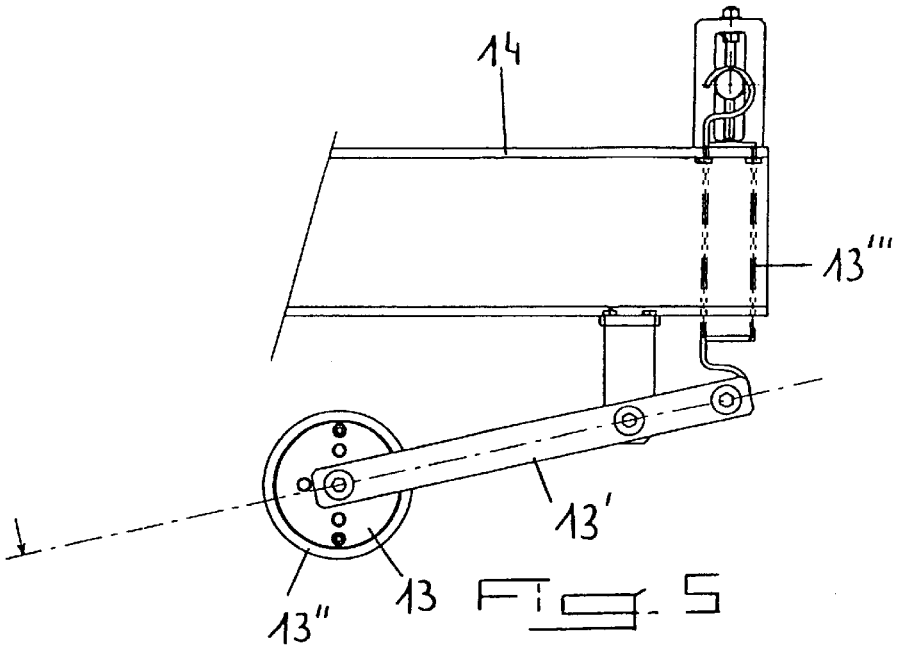
Fig. 5
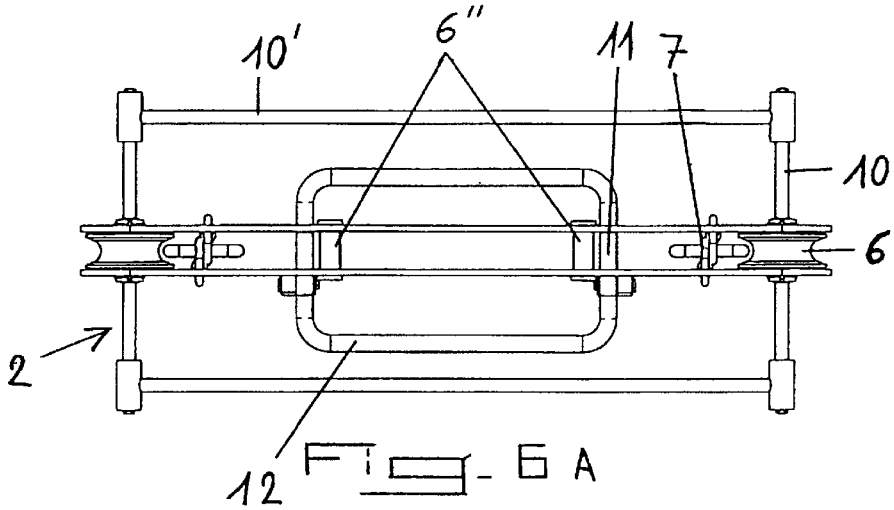
Fig. 6A
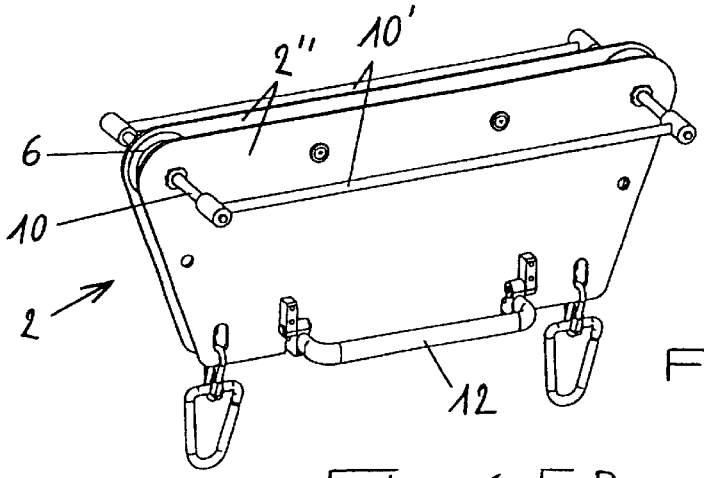
Fig. 6
Fig. 6B

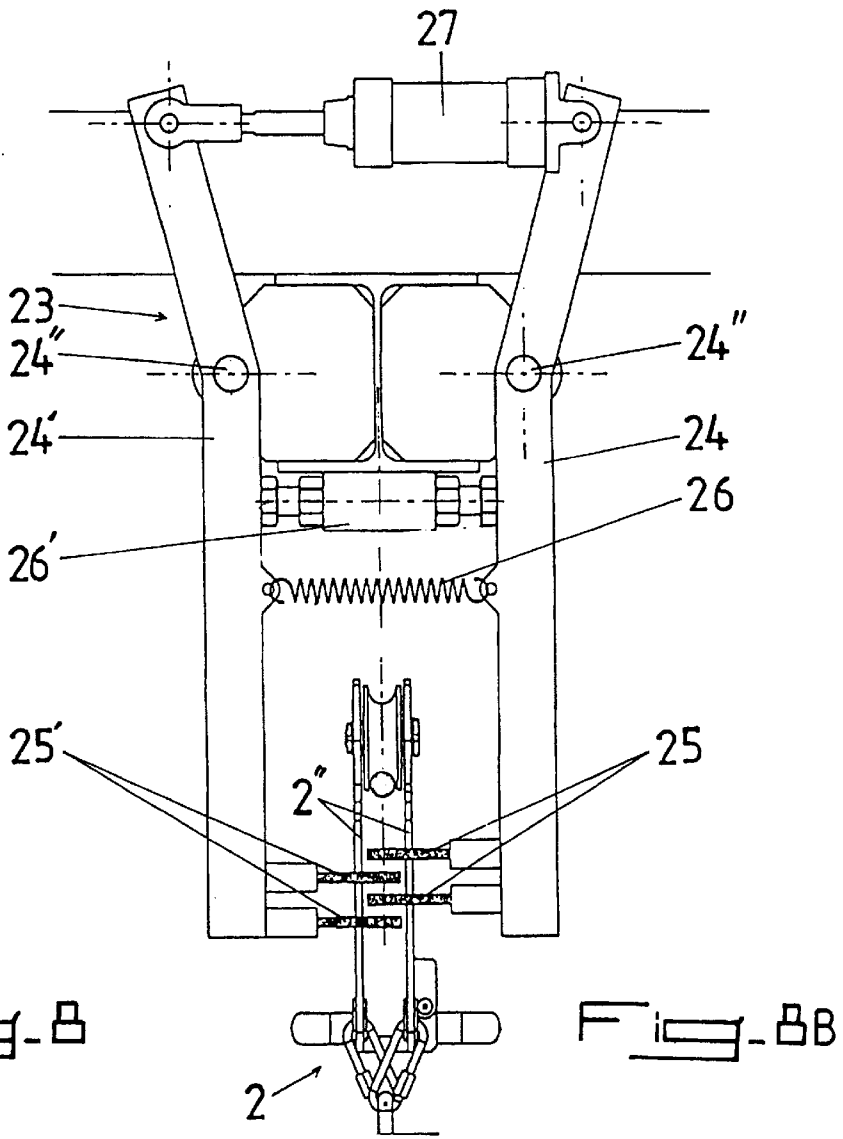
Fig-8B
Fig-8
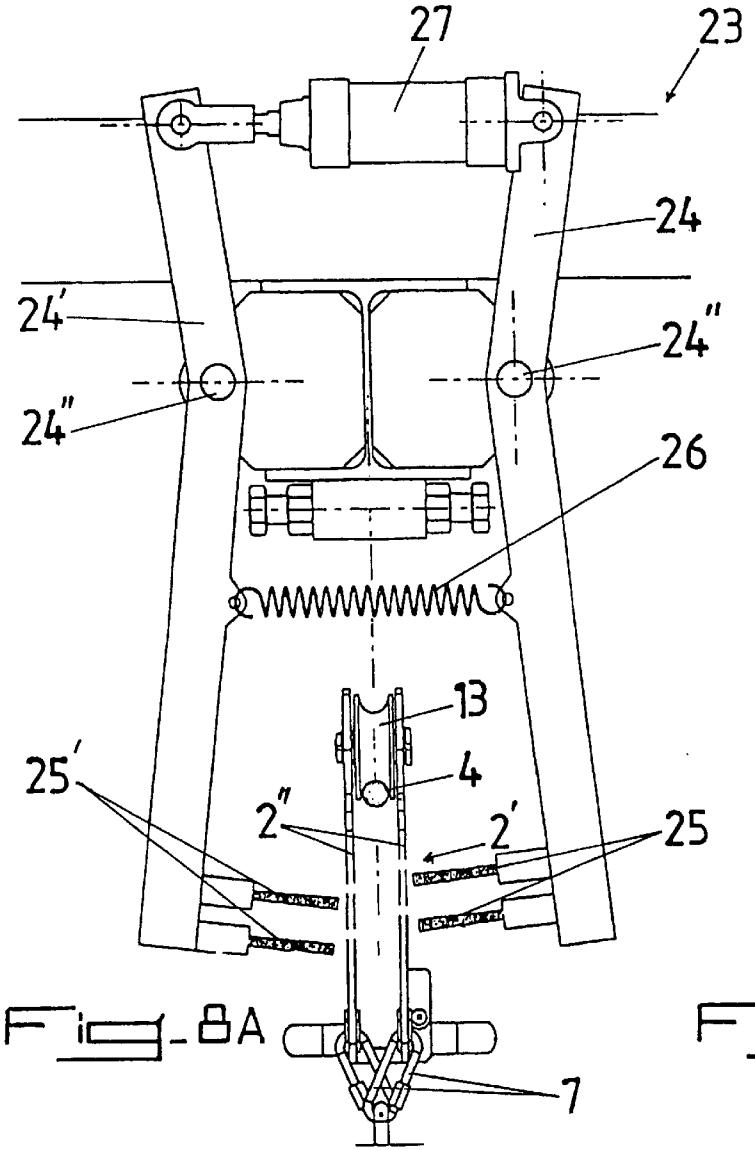
Fig-8A

TRANSPORT DEVICE COMPRISING AT LEAST ONE CARRIAGE OR LIKE VEHICLE CIRCULATING ON A CABLE

BODY OF THE INVENTION

The present invention relates to the field of high speed transport on a cable or a like support, under the action of the weight or if desired by motorized movement, preferably for pleasure, but if desired also in a utilitarian field, or even a professional field, and has for its object a transport device comprising a carriage circulating on a cable or a like support.

There already exist different systems for transport of goods and persons on cables, particularly by free wheel displacement under the action of gravity.

However, these existing systems often have serious faults in terms of reliability of operation and of safety during movement on the cable and particularly during the stopping phase upon arrival, resulting in high risk of damage or injury, particularly at high speeds, for example greater than about 70 km/h.

SUMMARY OF THE INVENTION

The present invention particularly has for its object to overcome the mentioned drawbacks.

To this end, it has for its object a transport device comprising at least one carriage or like vehicle circulating on a cable or similar elongated support element extending between a departure station and an arrival station, the departure station being preferably located at a higher altitude than the arrival station, characterized in that said carriage comprises at least rolling means adapted to circulate on said cable or like elongated support element and mounted in a chassis forming the body of the carriage and provided with means for securing the objects and/or subjects to be transported and in that the arrival station comprises at least one braking unit for the carriage automatically and mechanically interacting with at least a portion of the chassis of this latter and/or at least one extension of the latter during passage of said carriage at its level.

BRIEF DESCRIPTION OF THE DRAWINGS

The invention will be better understood from the following description, which relates to preferred embodiments, given by way of non-limiting example, and explained with reference to the accompanying schematic drawings, in which:

FIG. 5 is a side elevational view, on a different scale, of a braking roller forming a portion of the device shown in FIG. 3;

FIGS. 6A and 6B are views respectively from above and in perspective, of a carriage forming a portion of the transport device, according to a second modified embodiment of the invention;

FIGS. 8A and 8B are front elevational views and on a different scale, of a pre-braking module forming a portion of the unit shown in FIG. 7, respectively in the released or inactive unit and in the engaged or active unit.

DESCRIPTION OF THE PREFERRED EMBODIMENTS

Figure 1:
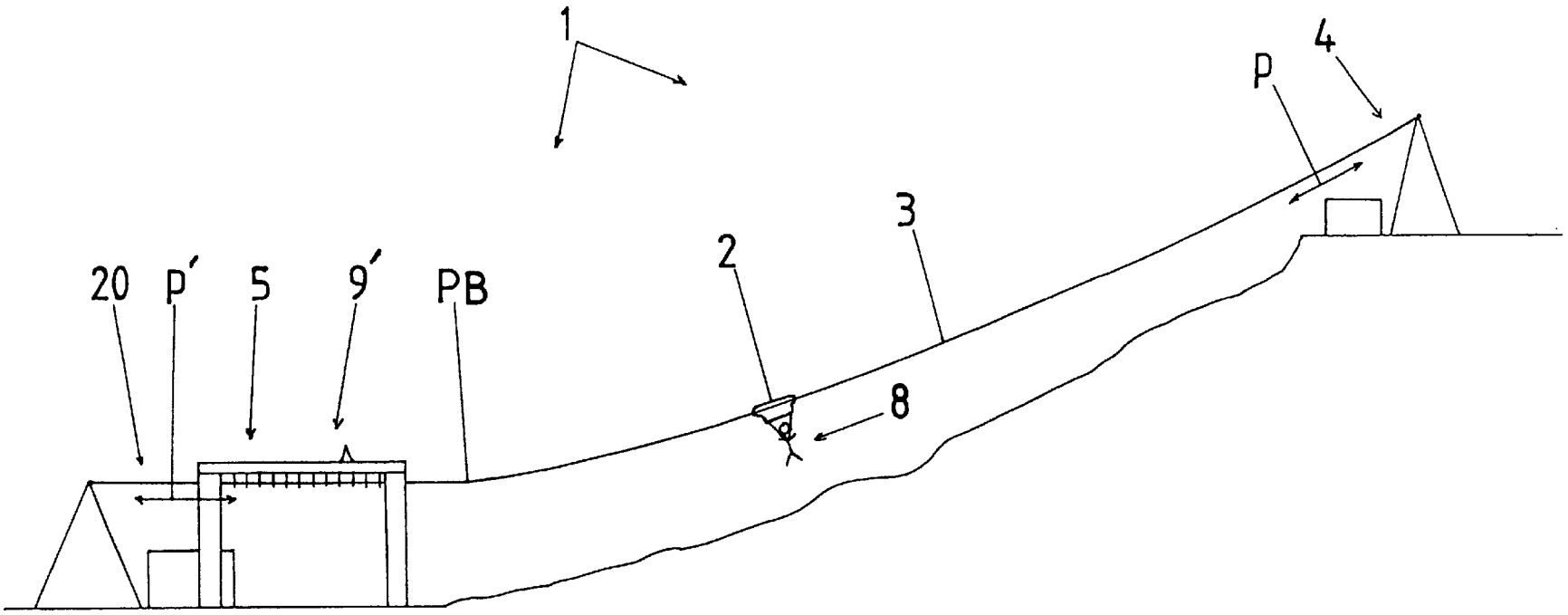
FIG. 1 is a schematic representation of a transport device according to the invention.
Figure 2:
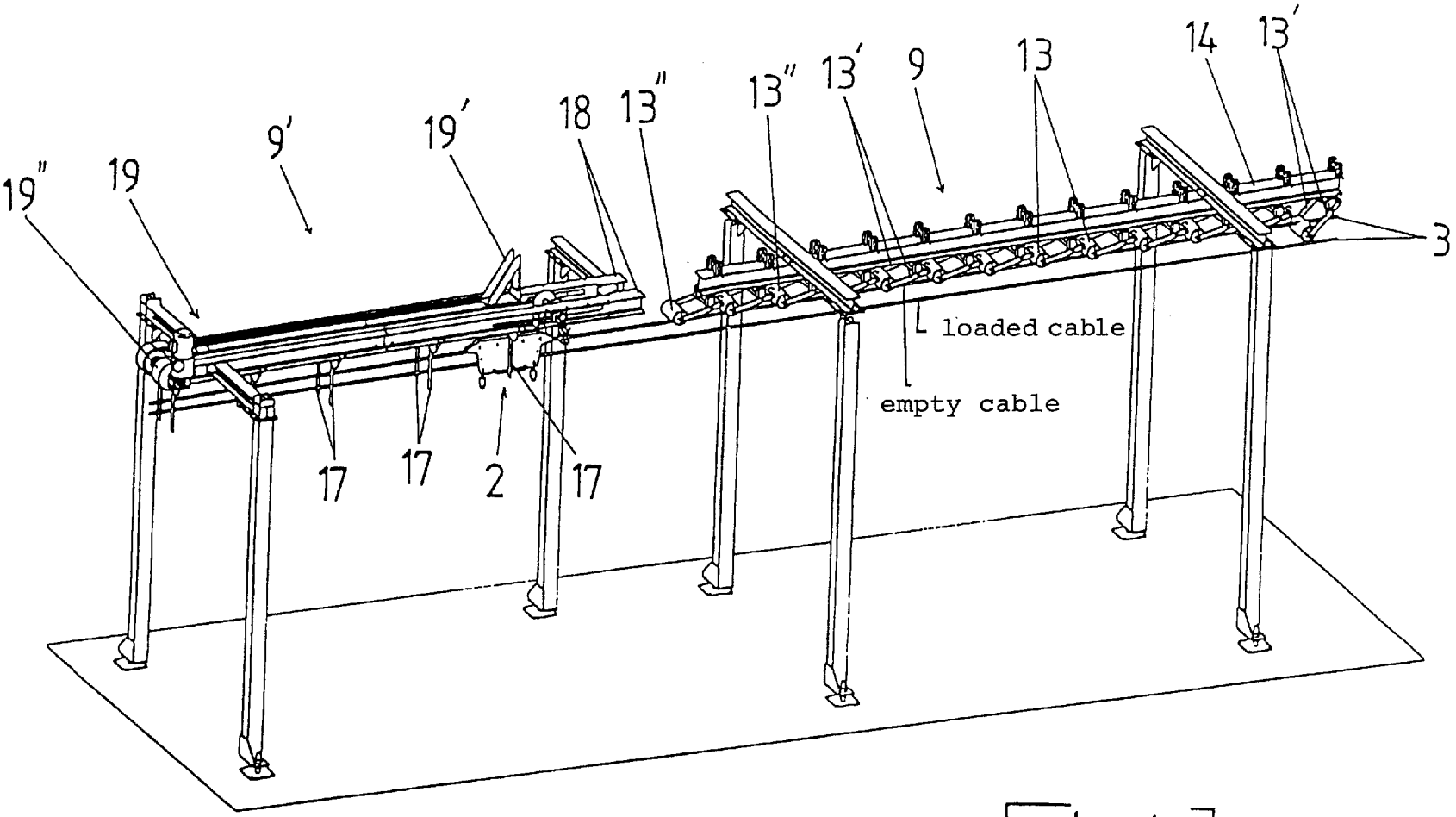
FIG. 2 is a perspective view of two braking units forming a portion of the transport device of claim 1 according to a modified embodiment of the invention.
Figure 3:
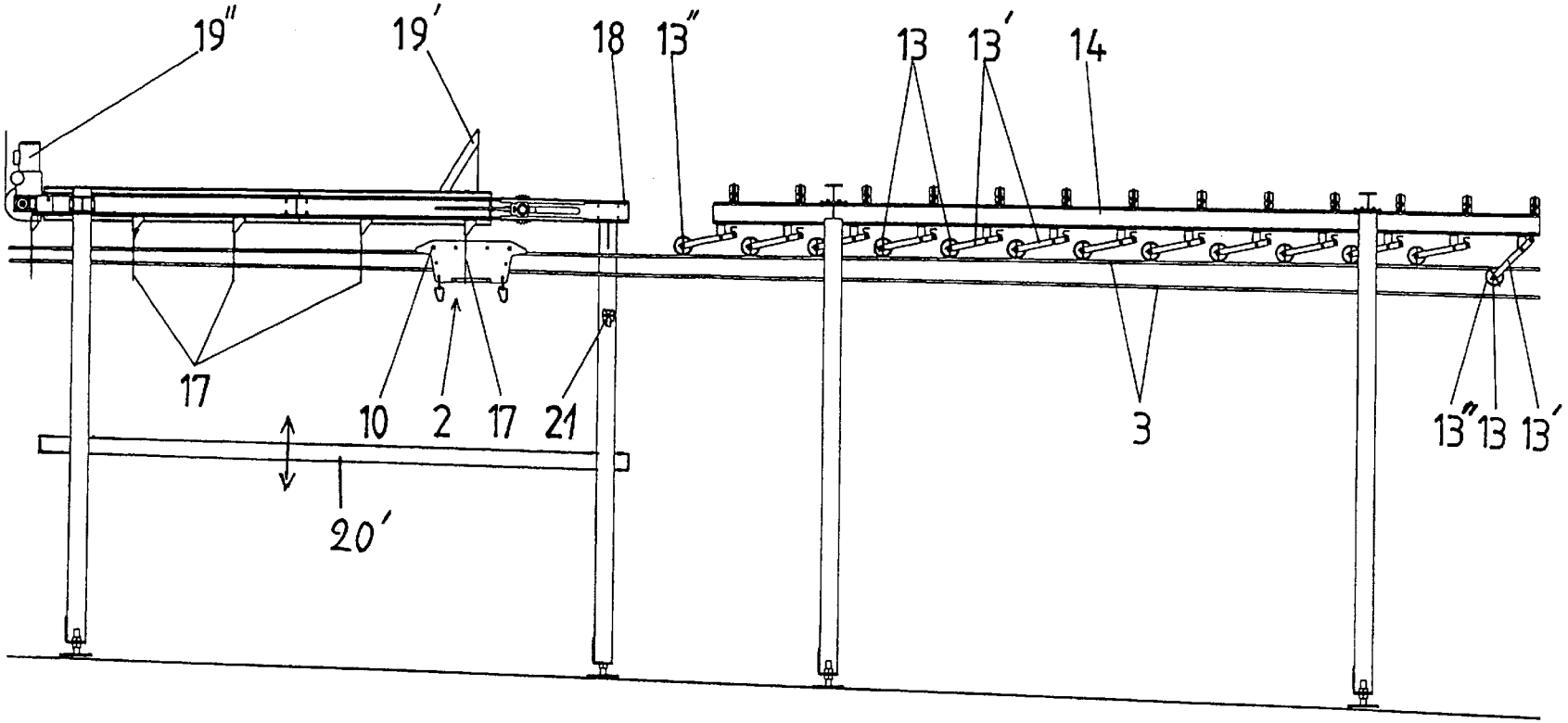
FIG. 3 is a side elevational view of the braking elements shown in FIG. 1.

As shown in FIGS. 1 to 3 of the accompanying drawings, the transport device 1 comprises at least one carriage or like vehicle 2 circulating on a cable or a similar elongated support element 3 (for example a bar or several parallel cables in a bundle) extending between a departure station 4 and an arrival station 5, the departure station 4 being preferably located at a higher altitude than the arrival station 5.

According to the invention, the carriage 2 comprises at least one rolling means 6 adapted to circulate on said cable or similar elongated support element 3 and mounted in a chassis 2' forming the body of the carriage 2 and provided with securement means of the object and/or subjects 8 to be transported, the arrival station 5 comprising at least one braking unit 9, 9' for the carriage 2 automatically and mechanically interacting with at least a portion of the chassis 2' of this latter and/or at least one extension 10 of the latter during passage of said carriage 2 at its level.

So as already to provide a first progressive braking under the influence of gravity, it can be provided that the cable or elongated support element 3 has, adjacent the arrival station 5, a slope P' or an inclination opposite a slope P which it has adjacent the departure station 4.

Thus, as shown in FIG. 1 of the accompanying drawings, cable 3 will have a low point PB between the departure station 4 and the arrival station 5 and an ascending slope P' between this low point and said station 5, which will necessarily effect a slowing of the moving carriage.

According to a characteristic of the invention, shown particularly in FIGS. 4A to 4D of the accompanying drawings, the carriage 2 comprises two rolling means 6, for example in the form of rollers or pulley wheels, located substantially toward the two longitudinal ends of said carriage 2 and in the upper portion of this latter, and the chassis 2' is principally constituted by elements in the form of metallic plates 2" secured to the axles of rotation 6' of the rolling means 6 and extending parallel on opposite sides of said rolling means 6, toward the bottom of the chassis 2' when said carriage 2 circulates on said cable or like support 3, the securement means 7 being located in the lower portion of said chassis 2'.

Figures 4, 4A, 4B, 4C, 4D:
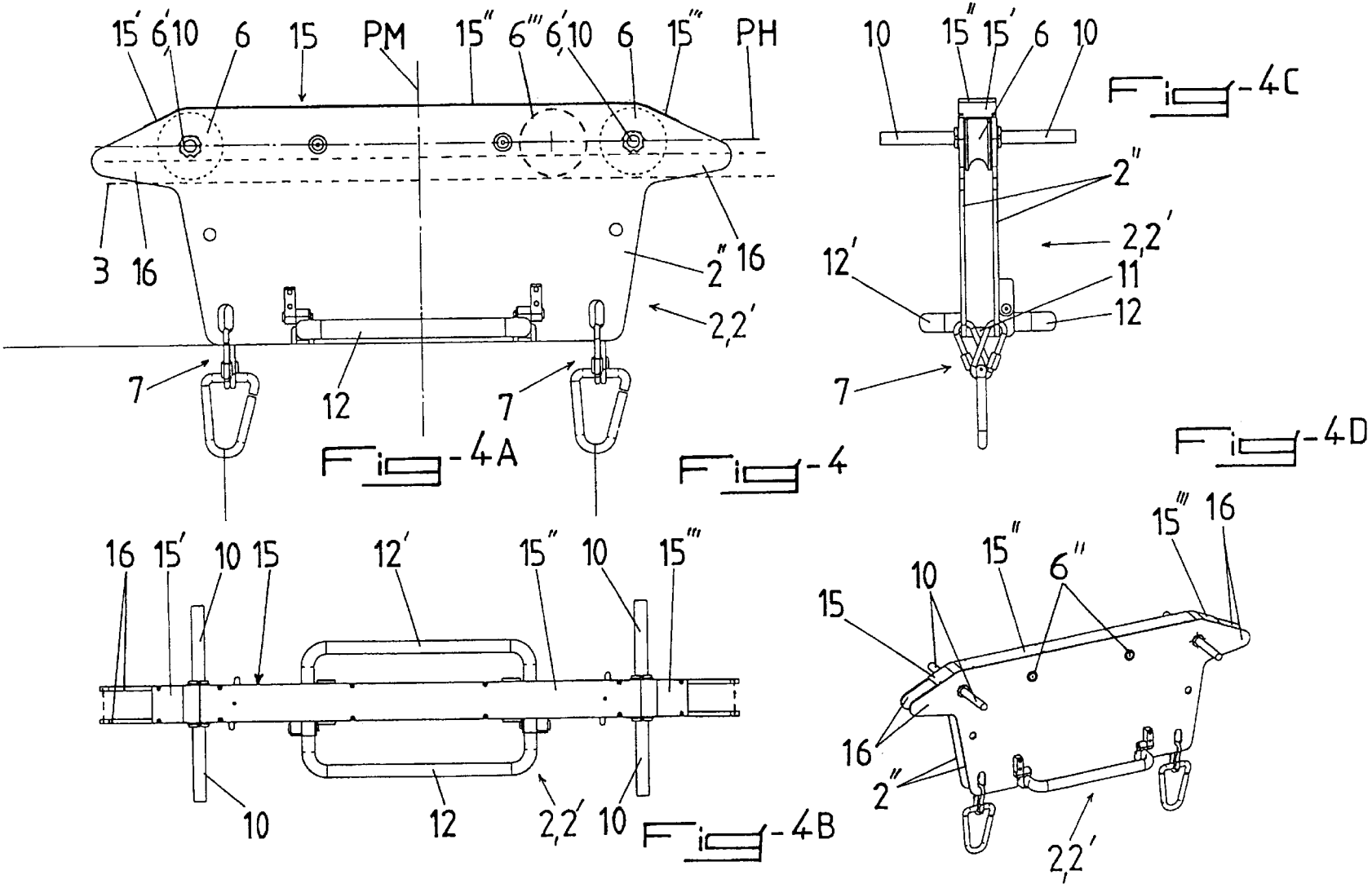
FIGS. 4A, 4B, 4C and 4D are views, on a different scale, respectively in side elevation, from above, in front elevation and in perspective, of a carriage forming a portion of the transport device, according to a first modified embodiment of the invention.

As also shown in FIGS. 4 of the accompanying drawings, the chassis 2' of the carriage 2 is open over all its length at the level of its lower portion so as to constitute an opening for the passage of the cable 3 and comprises at this level at least one removable bracing member 11 that can be inserted between the two plates 2" by actuation of a corresponding control handle 12, so as to guarantee the spacing of said plates 2" at the level of said lower portion and, as the case may be, to rigidify the structure of said chassis 2' particularly when the bracing member 11 is provided at its free end with a hook.

Such a structure of the transport carriage 2 ensures optimum safety against involuntary uncoupling, in particular in the course of movement, precise guidance (the bottom of the peripheral groove of the corresponding roller substantially at the external surface of the half section of the cable 3), good stability in the course of movement (no back and forth swinging, limited lateral swinging) and low aerodynamical resistance.

The control handle 12, which preferentially moves the bracing member 11 by means of a toggle joint mechanism, could also serve, in association with a counter handle 12', as the supplemental engagement handle for the transported person Moreover, this construction of the carriage 2 permits rapid mounting and unmounting of this latter relative to the cable 3.

So as to ensure reliable mounting and holding on the cable 3, the structure and distribution of the masses of the portions comprising the carriage 3 are such that the center of inertia of the carriage 2 is located substantially below the plane PH containing the axes 6' of the rolling means 6 and substantially in the vertical plane containing the longitudinal axis of the portion of cable 3 on which the carriage 2 rests, this latter having moreover preferably a structure that is symmetrical relative to the median plane PM parallel to the axles 6' of the rolling means 6.

This latter characteristic permits moreover a totally reversible mounting and use of said carriage 2.

As shown in FIGS. 4D, 6A and 6B of the accompanying drawings, the carriage could also comprise at least one, preferably two, safety axles 6" connecting the two plates 2" and located substantially at the same level as the rotation axles 6', so as to maintain the carriage 2 on the cable 3 in case of breaking of one of the two rotation axles 6'.

As a modification, the carriage 2 could, to take account of the asymmetric distribution of the weight of the subject 8 suspended by securement means 7, comprise a third rolling means 6'" (FIG. 4A) located immediately after the front rolling means 6 or at the front during movement of the carriage 2.

The rolling means 6, 6'", for example in the form of grooved rollers, could be made of a synthetic material of polyurethane base or preferably of Nylon (trademark), particularly of Delrin (trademark).

According to a first modified embodiment of the invention, shown in FIGS. 2 and 3 of the accompanying drawings, the braking unit 9 could consist of a plurality of rollers or rotatable wheels 13 mounted in a series, by means of respective pivoting arms 13', on an elongated carrying body 14 extending substantially parallel to and above a portion of the cable 3, at the level of the arrival station 5, the rollers or pulleys 13 being normally in bearing relation against said cable portion 3 when this latter is not loaded and interacting with said carriage 2, when this latter passes at its level, by rolling on a roller train 15 provided at the level of the upper portion of the chassis 2' of said carriage 2.

For efficacious and easily adjustable braking, at least one, and preferably each, roller or pulley 13 is pressed in the direction of the cable 3 under the action of a resilient urging means 13'", adjustable as the case may be, and is covered over its external surface with a layer 13" of a plastic material with a high coefficient of friction, said pulleys or rollers 13 being if desired at least in part, free wheeling and/or provided with rotating means and/or rotational braking means.

The layer 13" could for example consist of a polyurethane base material and the bodies of the rollers or pulleys 13 could have a massive structure giving rise to a large inertia in rotation, the pulleys or rollers 13 at the head of the braking unit 13 preferably having an inertia of rotation which is lower.

An exemplified embodiment of mounting of a braking roller or pulley 13 is shown in FIG. 5 of the accompanying drawings.

The rotation of said rollers or pulleys 13 could moreover be if desired at least partially controlled for example by associating them with mechanisms increasing their resistance to rotation or placing them in rotation even before the carriage 2 passes by.

These measures permit softening the braking effect and adjusting its effectiveness, for example as a function of the secured load of the carriage 2.

According to one characteristic of the invention, shown in FIG. 4 of the accompanying drawings, the rolling path 15 can be constituted, at least in part, by a strip, for example of sheet metal, delimiting the upper portion of the chassis 2' of the carriage 2 and securing together the two plate-shaped elements 2" forming the body of this latter and, as the case may be, in part by the upper edges of said plates 2", said rolling path 15 having, seen relative to the plane PH containing the axes of rotation 6' of the rolling means 6, successively a first rising portion 15', and a second horizontal portion 15", and finally a third descending portion 15'", the portions of rising slope 15' and descending slope 15'" being supported by protuberances 16 in the form of those beaks of the plates 2" constituting the body of the chassis 2', the free ends of said protuberances 16 being substantially level with the upper bearing surface of the cable and of the similar elongated support element 3 when the carriage 2 rests on this latter.

Said protuberances 16 could as the case may be also fulfill a function of guiding and/or cleaning cable 3 before its passage at the level of the rolling means 6.

As a modification, the rolling path could if desired be constituted by nothing but the upper edges of the plates 2" having at their longitudinal edges rounded shapes.

The first rising portion 15' and/or the third descending portion 15'" could if desired be prolonged, or comprise an associated prolongation element, to come to a very small distance from the cable 4 when the carriage 2 is mounted on this latter (see the broken lines in FIG. 4B). They will permit a passage or a gentle rising of the rollers or pulleys 13 on the rolling path (as well as if desired a progressive descent of these latter) and will also constitute scrapers permitting freeing the cable from below of any deposit, such as for example snow, frost, dead leaves or the like, that may be present to a certain depth.

According to a second modified embodiment, also shown in FIGS. 2 and 3 of the accompanying drawings, the braking unit can consist of a plurality of consecutive elongated strip or plate portions 17, disposed on opposite sides of the cable 3 in pairs spaced along the latter, extending substantially perpendicular to this latter and adapted to interact with the lateral extensions 10 of the carriage 2, for example extensions of the axles 6' of the rolling means 6, said strip or plate portions 17, for example in the form of strips, being raised, particularly by being resiliently deformed by flexure, during passage of the carriage 2 along lateral extensions 10 of this latter.

The thickness of said portions 17, as well as the rigidity of the material or materials constituting them, can vary, for example progressively, along the carrying body 18.

Similarly, the portions of the elongated strip or plate 17 are fixed rigidly or pivotally by one of their ends on the elongated carrying body 18 extending substantially parallel to and above a portion of the cable 3 at the level of the arrival station 5, said portions 17 extending at most to the level of the securement means 7 of the chassis 2' of a carriage 2 located at its level when the latter is empty.

When the strip or plate portions 17 or a portion of the latter are pivotally mounted, this pivoting takes place against resilient constraint, which if desired may be adjustable.

So as to avoid during use any deformation by flexure of the lateral extensions 10 in the form of bars, the latter can if desired be interconnected two by two by elongated rigidification members 10' (see FIGS. 6A and 6B).

As indicated above, the single braking unit 9 or 9' could be present in two separate modifications, each adapted independently, if desired in connection with another braking device or stopping device, to brake and preferably to immobilize the carriage 2 at the level of the arrival station 5.

However, according to a preferred embodiment of the invention, shown in FIGS. 2 and 3 of the accompanying drawings, the arrival station 5 comprises two braking units 9 and 9' disposed in series along an end portion of the cable 3 or of the similar elongated support element, namely a first braking unit 9 with rollers or pulleys 13 followed by a second braking unit 9' with strips 17.

So as systematically to move the carriage 2 to a predetermined position for its freeing, the braking unit 9', or the second 9' of two braking units 9 and 9', comprises a drive device 19 adapted to bring the carriage 2, from its stopped position reached by the action of said braking unit or 9', by traction or pressure, to a discharge station or platform 20.

According to a supplemental characteristic of the invention, the drive device 19 can for example consist of at least one pusher 19' circulating along the elongated carrying body 18, on which are mounted elongated strip or plate portions 17, and adapted to come into engagement at the level of the upper portion of the chassis 2' of the carriage 2, preferably at the level of lateral extensions 10 of this latter, so that at least one pusher 19' being secured to a chain or endless band driven by an actuator 19", the control of this latter taking place as a function of signals delivered by a cell 21 for the detection of the passage of the carriage 2 located at the head of the braking unit 9 or 9'.

The pusher 19' could remain ready in a retracted position until the passage of a carriage 2 at the level of the cell 21 which will trigger its movement toward the stopped position of said carriage 2 for its driving.

As seen in FIG. 3 of the accompanying drawings, there could also be provided a retractable platform 20', extending substantially over all the length of the station or braking unit 9' and adapted to be vertically displaced between a low or retracted position and a high position in which people 8 associated with the carriages 2 could board the latter.

So as to guarantee greater safety of use of the device according to the invention, and particularly to permit adjustment of the speed of movement of the carriage 2 within a predetermined range at the inlet of the unit or of the first braking unit 9, 9' to ensure stopping said carriage 2 at the level of this unit, the device 1 can comprise moreover a pre-braking unit 22 located upstream of the braking unit or units 9, 9' and comprising at least one, and preferably several, modules 23 fixedly disposed along the carrying cable 3, each module 23 being controlled individually to pass in a reversible manner from an inactive condition in which it does not act on the movement of the carriage 2, to an active condition in which it interacts with the chassis 2' of the carriage 2 during upward passage of said module 23, for example in the form of a sliding contact with a frictional and/or flexural resistance.

Figure 7:
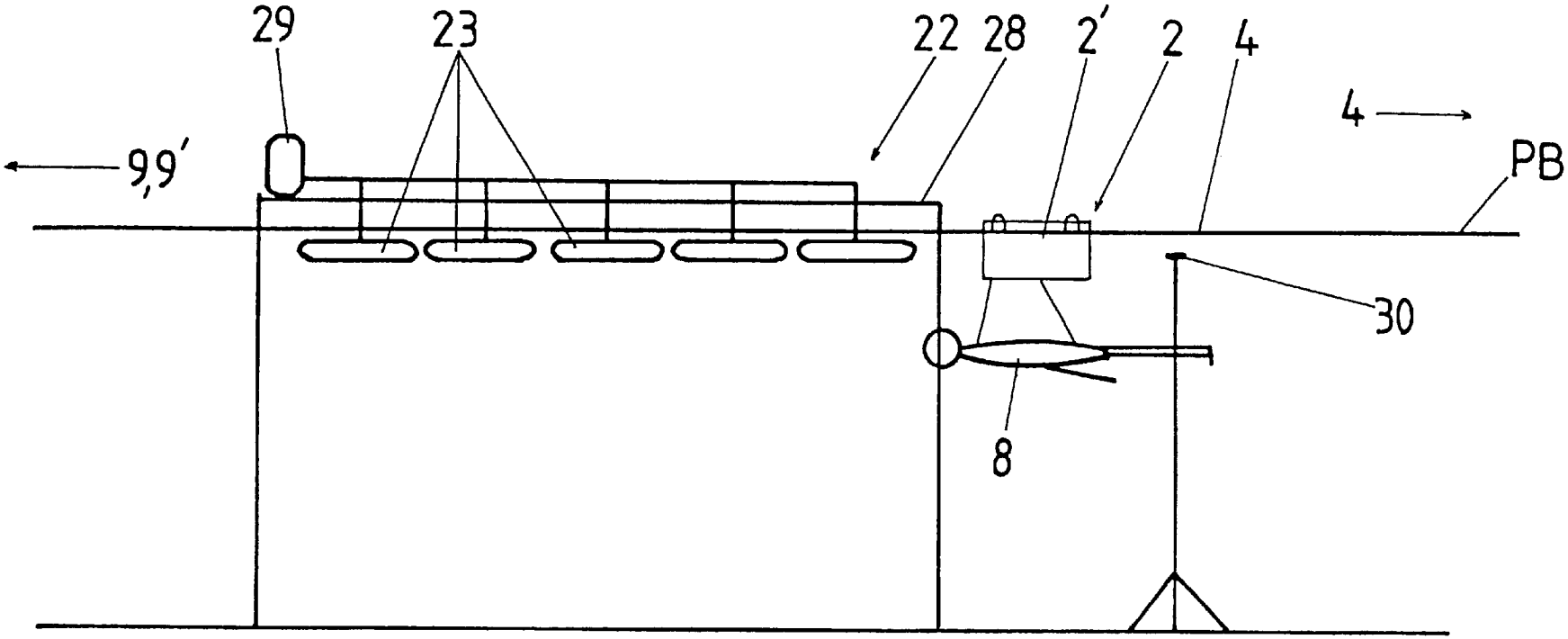
FIG. 7 is a schematic representation of a pre-braking unit that can form a portion of the transport device according to the invention.

As shown in FIG. 7 of the accompanying drawings, this pre-braking unit 22 will preferably be located downstream of the point PB and could comprise a variable number of modules 23 as a function of the intensity of the maximum braking that is sought.

According to a preferred modified embodiment of the invention shown in FIGS. 8A and 8B of the accompanying drawings, each module 23 is present in the form of two opposite jaws 24, 24', mounted pivotably about substantially parallel axles with the portion of the cable 3 passing between them, provided with elongated flexible elements 25, 25', of rows of rotatable elements or frictional contact elements adapted to enter into contact with the chassis 2' of the carriage 2 at the moment of its passage, for slowing it and extending substantially in the direction of movement of the carriage 2 and connected to at least one actuator means 26, 27 for the movement of the two jaws 24, 24' about their respective pivotal axles 24', between an inactive spaced position and a closed active position.

The elongated flexible elements could for example consist of a pair of parallel spaced flexible brushes on the opposed jaws 24, 24', disposed, in the active condition of the module 23 in question, at least partially in the passage space of the carriage 2, if desired in an alternate arrangement with the pair of flexible brushes 25', 25 of the opposite jaw 24, 24'.

The rows of rotatable elements (not shown) could, for example, consist in rows of rollers or wheels of polyurethane, having a certain rotational inertia or coupled with braking means.

As also shown in FIGS. 8A and 8B of the accompanying drawings, the actuator means for each module 3 comprised preferably of a first passive actuator means 26, for example a spring, continuously urging the jaws 24, 24' toward their active position, and a second actuator means 27, for example a jack, positively controlled to space apart the jaws 24, 24' toward their inactive position, against the force of the first actuator means 26.

The jaws 24, 24' could for example together form a X structure with two separate arms pivotally articulated about axles 24" at the level of their respective inflection points. The actuator means in the form of spring 26, coacting with the piece 26' forming an abutment and defining the closed position of the jaws 24, 24', could preferably be located on the opposite side of said jaws 24, 24' relative to the pivotal axles 24".

Said pre-braking modules 23 are mounted in alignment on a supporting crossbeam 28 carrying, as the case may be, also the power supply or the pressure fluid 29 of the second actuator means 27, for example in the form of a compressor.

To be able to change the intensity of braking at the level of the pre-braking unit 22 with each carriage 2 (specific to speed and mass) arriving at the level of this latter, there can be provided a speed detector 30 located at a predetermined distance upstream of the pre-braking unit 22 and adapted to measure the speed of movement of a carriage 2 at the instant of its passage at its height, namely associated with different pre-braking modules 23 and controlling the actuation of none, one or several or all of said modules 23 as a function of the speed of arrival of said carriage 2 at the level of the pre-braking unit 22.

According to the particular embodiment of the invention shown in the accompanying drawings, the pre-braking unit 22 preferably comprises five pre-braking modules 23 each comprising two opposed jaws 24, 24', provided at their lower ends with two elements in the form of elongated brushes 25, 25' mounted on suitable brush carriers, such that in the closed position of said jaws 24, 24', the carriage 2 is obliged to open a passage through the brushes which mutually interpenetrate.

It will be noted that, given the nature of the first and second actuator means 26, 27 and of their respective mounting on the modules 23, this latter is in active or closed position in the rest condition and must be positively actuated to bring it into the inactive or open position, thereby providing security of use, even in the case of failure of the second actuator means 27.

Of course, the invention is not limited to the embodiments described and shown in the accompanying drawings. Modifications remain possible, particularly as to the construction of the various elements or by substitution of technical equivalents, without thereby departing from the scope of protection of the invention.

What is claimed is:

1. A transport device comprising:

an elongated support element extending between an arrival station that has a first braking unit and a departure station that is higher in elevation than said arrival station; and a vehicle having at least one first roller that is movable along said elongated support element and an upper surface defining a rolling path, said first braking unit comprising a plurality of second rollers in series that are pivotally attached to a first carrying body that is above said elongated support element at said arrival station, said plurality of second rollers engaging said elongated support element when said vehicle is not between said plurality of second rollers and said elongated support element and engaging said rolling path and slowing said vehicle when said vehicle is between said plurality of second rollers and said elongated support element.

2. The transport device of claim 1, wherein said vehicle comprises two of said first rollers that are adjacent to longitudinal ends of said vehicle, and wherein said vehicle comprises a chassis having two spaced-apart plates, said two first rollers being rotationally mounted between said two spaced-apart plates at an upper portion thereof, said chassis having a removable spacing member between said two spaced-apart plates at a lower portion thereof, a handle being provided for inserting said removable spacing member.

3. The transport device of claim 1, wherein each of said plurality of second rollers is urged toward said elongated support element by a resilient member.

4. The transport device of claim 1, wherein said vehicle comprises a chassis having two-spaced apart plates and wherein said rolling path is defined by a surface that connects said two spaced-apart plates at an upper portion thereof, said surface having a mesa generally parallel to said elongated support element and two ramps leading from a level substantially similar to an upper surface of said elongated support element to said mesa.

5. The transport device of claim 1, wherein said vehicle further comprises lateral extensions from both sides thereof, and wherein said transport device further comprises a second braking unit that has a plurality of downwardly depending members that are arranged in pairs on opposite sides of said elongated support member and that strike said lateral extensions.

6. The transport device of claim 5, wherein said second braking unit further comprises a second carrying body that is substantially parallel to and above said elongated support member, said downwardly depending members being attached to said second carrying body.

7. The transport device of claim 6, wherein said second braking unit further comprises a driver arranged and adapted to move said vehicle to a discharge area of said arrival station.

8. The transport device of claim 7, wherein said driver comprises a vehicle pusher mounted on said second carrying body, an actuator, a power transfer device connected to said actuator for moving said pusher, a cell that detects passage of said vehicle into said arrival station, and a controller that is responsive to said cell and connected to said first actuator.

9. The transport device of claim 1, further comprising a prebraking unit adjacent to said arrival station, said prebraking unit comprising at least one fixed module disposed along said elongated support member, said at least one fixed module having a first position in which said vehicle is slowed by said at least one fixed module and a second position in which said vehicle is not slowed by said at least one fixed module.

10. The transport device of claim 9, wherein said at least one fixed module comprises two pivotally connected jaws that straddle said elongated support member, each of said jaws having flexible members that contact said vehicle when said at least one fixed module is in said first position and said vehicle passes through said jaws, said at least one fixed module further comprising an actuator for reversibly moving said jaws between said first and second positions.

11. The transport device of claim 10, wherein said flexible members comprise flexible brushes and said actuator comprises a spring urging said jaws to said first position and a jack for moving said jaws to said second position.

12. The transport device of claim 11, further comprising a vehicle speed detector between said departure station and said prebraking unit, said vehicle speed detector controller movement of said jaws between said first and second positions.

13. The transport device of claim 1, further comprising a second braking unit in series with said first braking unit along said elongated support member.

14. A transport device comprising:

an elongated support element extending between an arrival station that has a first braking unit and a departure station that is higher in elevation than said arrival station; and a vehicle having at least one first roller that is movable along said elongated support element and lateral extensions from both sides thereof, said first braking unit comprising a plurality of downwardly depending members that are arranged in pairs on opposite sides of said elongated support member and that strike said lateral extensions and slow said vehicle as said vehicle enters said arrival station.

15. The transport device of claim 14, wherein said first braking unit further comprises a first carrying body that is substantially parallel to and above said elongated support member, said downwardly depending members being attached to said first carrying body.

16. The transport device of claim 14, further comprising a second braking unit in series with said first braking unit along said elongated support member, said second braking unit including a series of second rollers that are pivotally attached to a second carrying body that is above said elongated support element, said series of second rollers engaging said elongated support element when said vehicle is not between said plurality of second rollers and said elongated support element and engaging said vehicle when said vehicle is between said plurality of second rollers and said elongated support element.

17. The transport device of claim 16, wherein each of said second rollers is urged toward said elongated support element by a resilient member, and wherein said vehicle comprises a chassis having two-spaced apart plates, a surface between said two spaced-apart plates defining a rolling path for said second rollers, said rolling path having a mesa generally parallel to said elongated support element and two ramps leading from a level substantially similar to an upper surface of said elongated support element to said mesa.

18. The transport device of claim 14, further comprising a prebraking unit adjacent to said arrival station, said prebraking unit comprising at least one fixed module disposed along said elongated support member, said at least one fixed module having a first position in which said vehicle is slowed by said at least one fixed module and a second position in which said vehicle is not slowed by said at least one fixed module.

19. The transport device of claim 18, wherein said at least one fixed module comprises two pivotally connected jaws that straddle said elongated support member, each of said jaws having flexible brushes that contact said vehicle when said at least one fixed module is in said first position and said vehicle passes through said jaws, said at least one fixed module further comprising an actuator for moving said jaws between said first and second positions, said actuator comprising a spring urging said jaws to said first position and a jack for moving said jaws to said second position.

20. The transport device of claim 19, further comprising a vehicle speed detector between said departure station and said prebraking unit, said vehicle speed detector controller movement of said jaws between said first and second positions.

* * * * *